US005889498A

United States Patent [19]

Lange et al.

[11] Patent Number: 5,889,498

[45] Date of Patent: Mar. 30, 1999

[54] END-FIRE ARRAY ANTENNAS WITH DIVERGENT REFLECTOR

[75] Inventors: Mark Lange, Camarillo; Lou Altreche, Agoura, both of Calif.

[73] Assignee: California Amplifier Company, Camarillo, Calif.

[21] Appl. No.: 740,328

[22] Filed: Oct. 28, 1996

[51] Int. Cl.[6] ..... H01Q 19/12

[52] U.S. Cl. ..... 343/840; 343/833; 343/786

[58] Field of Search ..... 343/833, 834, 343/840, 815, 818, 786, 781 R, 700 MS

[56] References Cited

U.S. PATENT DOCUMENTS

| | | | |
|---|---|---|---|
| 2,588,610 | 3/1952 | Boothroyd et al. | 343/833 |
| 2,663,797 | 5/1953 | Kock | 343/786 |
| 3,742,512 | 6/1973 | Munson | 343/840 |
| 4,142,190 | 2/1979 | Kerr | 343/840 |
| 4,364,053 | 12/1982 | Hotine | 343/915 |
| 4,510,501 | 4/1985 | Woodward, Jr. et al. | 343/797 |
| 5,061,944 | 10/1991 | Powers et al. | 343/818 |
| 5,440,319 | 8/1995 | Raymond et al. | 343/833 |
| 5,666,126 | 9/1997 | Lange | 343/781 R |

OTHER PUBLICATIONS

Johnson, Richard C., et al., *Antenna Engineering Handbook,* McGraw–Hill, Inc., New York, third edition, chapter 2, p. 16, chapter 3, pp. 12–17 and chapter 12, pp. 16–17.

*Primary Examiner*—Don Wong
*Assistant Examiner*—Tan Ho
*Attorney, Agent, or Firm*—Koppel & Jacobs

[57] ABSTRACT

An end-fire array antenna achieves improved performance with an array of radiative members that are arranged collinearly between an array first end and an array second end and a divergent reflector which is arranged collinearly with the radiative members. The radiative members are spaced to facilitate radiation and reception of electromagnetic signals in an antenna direction which extends from the array second end and the divergent reflector is spaced from the array first end to enhance this radiation and reception. A wall of the reflector preferably diverges from an antenna axis by an angle in the region of 24 to 48 degrees. The divergent reflector terminates in an open end which has a transverse width that preferably exceeds 1.4 $\lambda_{dsgn}$ wherein $\lambda_{dsgn}$ is the design wavelength of the antenna. In-service antennas are modified with a divergent reflector that is configured for coupling to an existing antenna back wall or antenna cup.

28 Claims, 6 Drawing Sheets

END-FIRE ARRAY ANTENNAS WITH DIVERGENT REFLECTOR

BACKGROUND OF THE INVENTION

1. Field of the Invention

The present invention relates generally to antennas and, more particularly, to end-fire array antennas.

2. Description of the Related Art

An array antenna is an antenna which has a plurality of radiative members that are arranged and excited to obtain a particular radiation pattern having a radiation maximum in a desired direction. The radiative members are generally spaced so that their radiation phases add in the desired direction.

Antenna arrays can be classified as linear or planar arrays and as broadside or end-fire arrays. In a linear or collinear array, the radiative members are arranged in a collinear relationship and in a planar array, the members are arranged in a planar relationship. If the array members are arranged so that their radiation phases add in a direction which is orthogonal to the line or plane of the array, the array is said to be a broadside array. End-fire arrays are typically collinear arrays and the array members are arranged so that their radiation phases add in a direction which is collinear with the array.

An exemplary end-fire array is a Yagi antenna (sometimes referred to as a Yagi-Uda antenna) which typically has a radiator spaced between a reflector and a plurality of directors. Because radiation energy is fed to the radiator it is sometimes referred to as the driven member and the directors are referred to as parasitic or passive members. The directors are spaced to obtain radiation phasing which enhances the antenna gain. The direction of the radiation maximum is generally collinear with the array members and opposite the reflector. The members of an end-fire array (and, therefore, a Yagi antenna) can have any conventional radiating structure (e.g., disc, patch or dipole).

End-fire array antennas (and, in particular, Yagi antennas) are described in various antenna references. For example, see Johnson, Richard C., et al., *Antenna Engineering Handbook*, McGraw-Hill, Inc., New York, third edition, chapter 3, pp. 12–17 and chapter 12, pp. 16–17. An exemplary end-fire antenna is disclosed in U.S. Pat. No. 5,440,319 which issued Aug. 8, 1995 to Raymond, Joel, J., et al., and was assigned to California Amplifier Company, the assignee of the present invention.

A large number of conventional Yagi antennas have been placed in service in antenna systems of various industries (e.g., the wireless cable industry). The reflector associated with these antennas is typically a simple back wall or a cup-shaped structure. Although antennas of this type can be economically manufactured and are generally effective, their value would be enhanced if their performance parameters (e.g., gain, side-lobe rejection and front-to-back ratio) could be improved. Preferably, such improvement would be obtained with a simple, low-cost structure which is configured so that existing in-service antennas could be similarly modified.

SUMMARY OF THE INVENTION

The present invention is directed to end-fire array antennas which have an enhanced radiation pattern that is obtained with simple, low-cost structures.

This goal is achieved with an array of radiative members which are arranged collinearly between an array first end and an array second end and a divergent reflector which is arranged collinearly with the radiative members. The radiative members are spaced to facilitate radiation and reception of electromagnetic signals in an antenna direction which extends from the array second end and the divergent reflector is spaced from the array first end to enhance this radiation and reception.

The divergent reflector has a diverging wall which preferably diverges from an antenna axis by an angle in the region of 24 to 48 degrees. The divergent reflector terminates in an open end which has a transverse width that preferably exceeds 1.4 $\lambda_{dsgn}$ wherein $\lambda_{dsgn}$ is the wavelength of electromagnetic signals that the array antenna is designed radiate and receive.

The teachings of the invention are extended to in-service antennas by providing a divergent reflector that is configured for coupling to an existing antenna back wall or antenna cup. In one embodiment, this coupling is achieved with a resilient clip. In another embodiment, the coupling is achieved with a two-part fastener.

The novel features of the invention are set forth with particularity in the appended claims. The invention will be best understood from the following description when read in conjunction with the accompanying drawings.

DETAILED DESCRIPTION OF THE PREFERRED EMBODIMENTS

Figure 1:
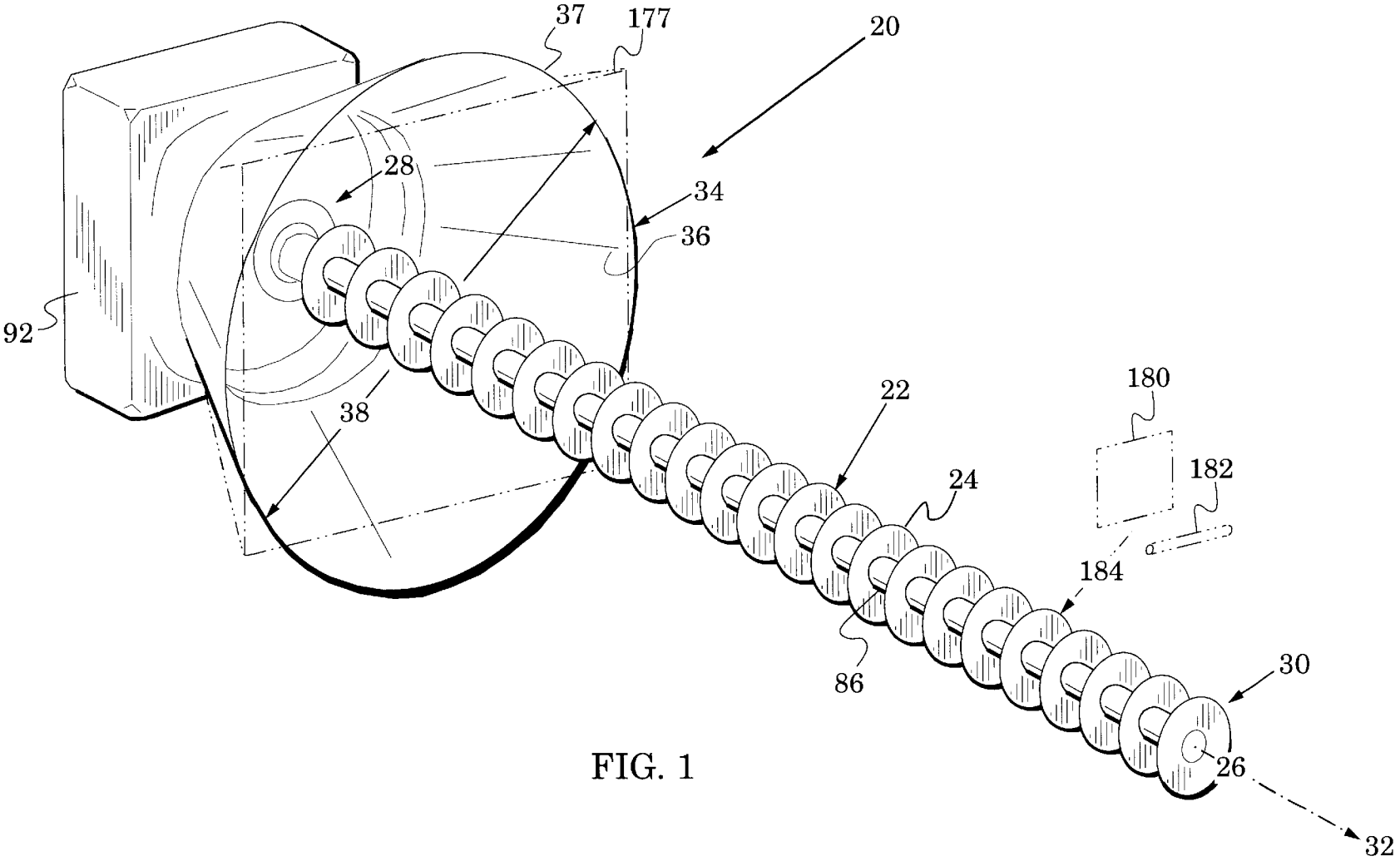
FIG. 1 is a perspective view of an end-fire array antenna in accordance with the present invention.

FIG. 1 illustrates an end-fire array antenna 20 in accordance with the present invention. In comparison to conventional end-fire array antennas, the antenna 20 exhibits improved antenna performance parameters (e.g., gain, side-lobe rejection and front-to-back ratio).

The antenna 20 includes an array 22 of radiative members 24 which are arranged collinearly along an antenna axis 26 between an array first end 28 and an array second end 30. The radiative members are spaced apart to realize signal phasing that facilitates radiation and reception of electromagnetic signals in an antenna direction 32 which extends collinearly from the array second end 30. Accordingly, the antenna is of the class of antennas commonly referred to as end-fire arrays.

The antenna 20 also includes a divergent reflector 34 that is arranged collinearly with the radiative members 24 and is spaced from the array first end 28. The reflector 34 has a wall 36 which diverges from the antenna axis 26 to enhance radiation and reception of electromagnetic signals in the antenna direction 32. The diverging wall 36 terminates in a reflector aperture 37 which has an aperture diameter 38.

Figure 2:
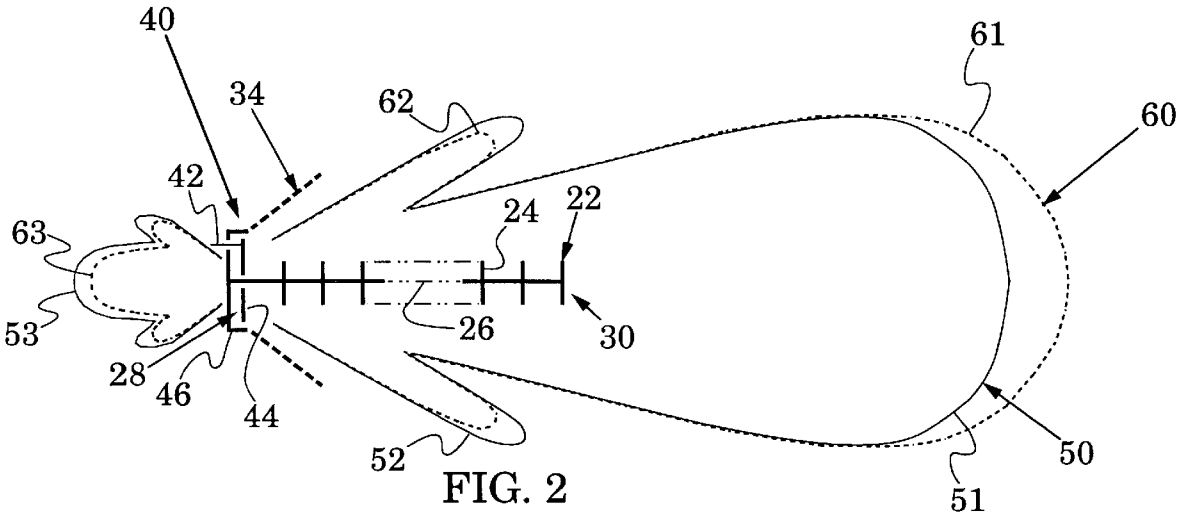
FIG. 2 is a schematic side view of the end-fire array antenna of FIG. 1 which shows an improved far-field radiation pattern obtained with this antenna.

FIG. 2 illustrates improved far-field antenna parameters in an embodiment 40 of the end-fire array antenna 20. In this embodiment 40, a probe 42 is coupled to one radiative member 44 at the array first end 28. This member is isolated from the remainder of the radiative members 24 which are mechanically supported from a cup 46 that is spaced from the radiative member 44. End-fire array antennas having this arrangement are typically referred to as Yagi antennas. In these end-fire array antennas, the radiative member 44 is typically referred to as a radiator and the other radiative members are referred to as directors.

Radiated power was measured on a prototype of the embodiment 40. Initially the divergent reflector 34 was removed (indicated by showing the reflector in broken lines). With the divergent reflector removed, an antenna radiation pattern 50 was measured which shows relative power in a main lobe 51, primary side lobes 52 and a rear lobe 53 (for clarity of illustration, lesser side lobes and other side lobes of the rear lobe are not shown).

The divergent reflector 34 of FIG. 1 was then coupled to the cup 46 and radiated power remeasured. The divergent reflector 34 is shown in broken lines and the corresponding antenna radiation pattern 60 is also shown in broken lines. The pattern 60 indicates relative power in a main lobe 61, primary side lobes 62 and a rear lobe 63. The addition of the divergent reflector 34 is seen to significantly reduce energy of the side lobes and the rear lobe and increase the energy in the main lobe.

Figure 3B:
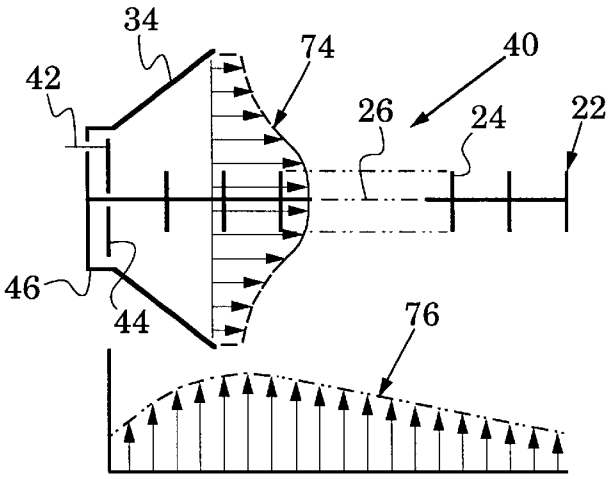
FIG. 3B illustrates theoretical transverse and axial electric field distributions of the end-fire array antenna of FIG. 1.
Figure 3A:
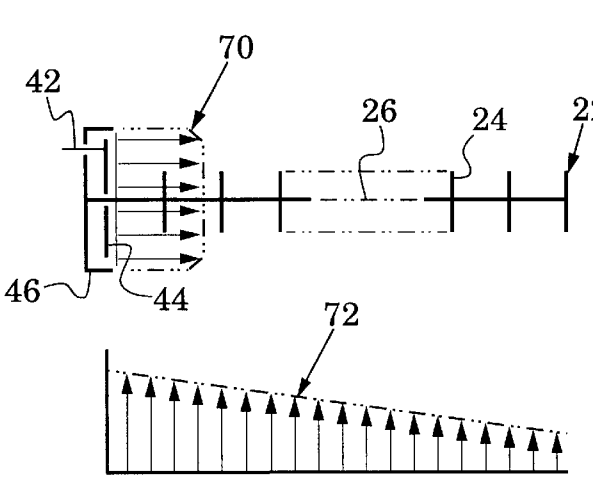
FIG. 3A (PRIOR ART)
FIG. 3A illustrates theoretical transverse and axial electric field distributions of a conventional end-fire array antenna.

It is theorized that this improved far-field radiation pattern is obtained because the divergent reflector 34 favorably reshapes the near-field distribution across the reflector's aperture and along the antenna's array. FIGS. 3A and 3B illustrate transverse and axial electric field distributions in accordance with this theory.

FIG. 3A is directed to the antenna embodiment 40 with the divergent reflector 34 removed. It shows a flat electric field amplitude distribution 70 across the cup 46 and a tapered electric field amplitude distribution 72 along the antenna axis 26. In contrast, FIG. 3B shows that the divergent reflector 34 generates a raised-cosine electric field amplitude distribution 74 across the reflector and an electric field amplitude distribution 76 along the antenna axis 26 whose maximum is shifted axially away from the cup 46. Although these electric field distributions are only theorized, it is known that such shaping of the near-field is consistent with the measured improvement shown in the radiation patterns 50 and 60 of FIG. 2 (e.g., see Johnson, Richard C., et al., *Antenna Engineering Handbook*, McGraw-Hill, Inc., New York, third edition, chapter 2, p. 16).

Figure 4:
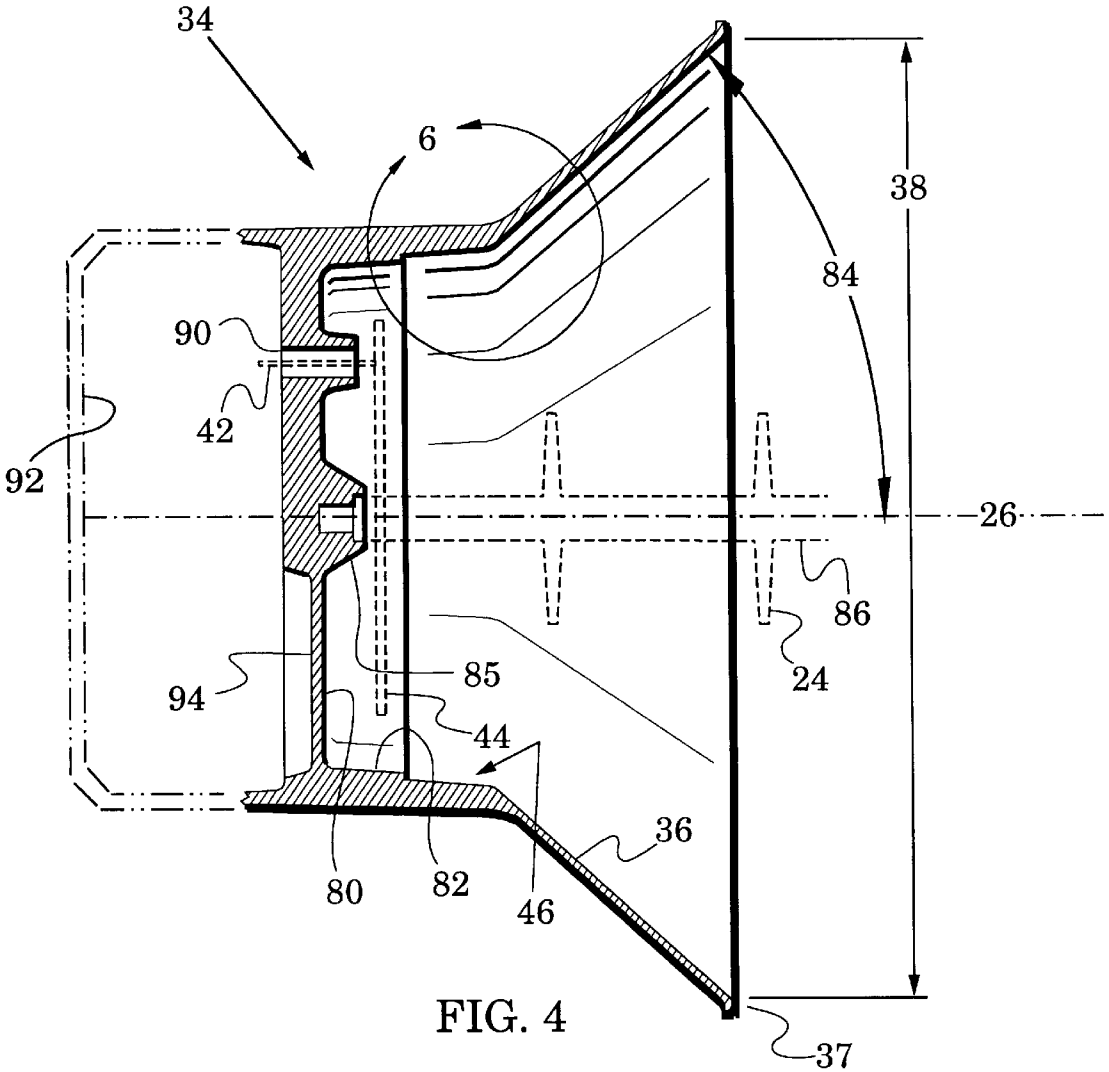
FIG. 4 is a sectional view of a divergent reflector in the end-fire array antenna of FIG. 1.

As illustrated in FIG. 4, an exemplary embodiment of the divergent reflector 34 has a transverse back wall 80 and an annular wall 82 which together form the cup 46 of FIG. 2. The diverging wall 36 extends from the cup 46 and diverges from the antenna axis 26 by a diverging angle 84. The wall 36 terminates in the aperture 37 which has the aperture diameter 38. The cone-shaped reflector 34 is essentially formed by a conic frustum (the diverging wall 36) that is coupled to the cup 46.

The back wall 80 forms a boss 85 which can receive (e.g., threadably receive) an axially-directed rod 86 that carries the radiative members 24. The back wall 80 also forms a passage 90 through which the probe (42 in FIG. 2) can be led to antenna-associated circuits in a chamber 92 which is generally indicated by broken lines (the chamber 92 is also shown in FIG. 1). The probe 42 couples to the radiative member 44 which is formed of a conductive metal (e.g., tin-plated copper) and is isolated (e.g., by insulative washers which are not shown) from the rod 86 and the divergent reflector 34. To reduce weight, the back wall 80 can form relief pockets 94 which locally reduce the wall thickness.

If the end-fire array antenna 20 is used as a receiving antenna, the chamber 92 can house receiving circuits (e.g., a low-noise amplifier and a downconverter). If the end-fire array antenna 20 is used as a transmitting antenna, the chamber 90 can house transmitting circuits (e.g., a power amplifier).

Figure 5A:
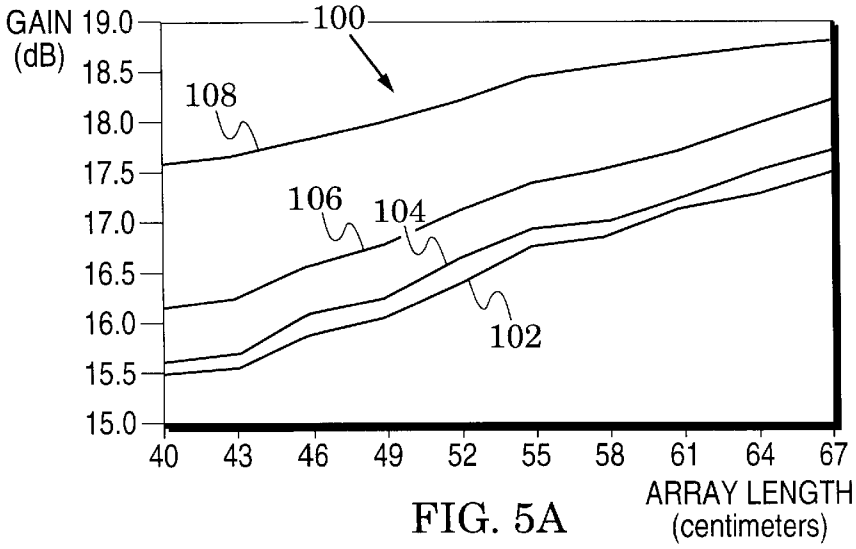
FIG. 5A is a graph of measured gains in different prototypes of the end-fire array antenna of FIG. 1.
Figure 5B:
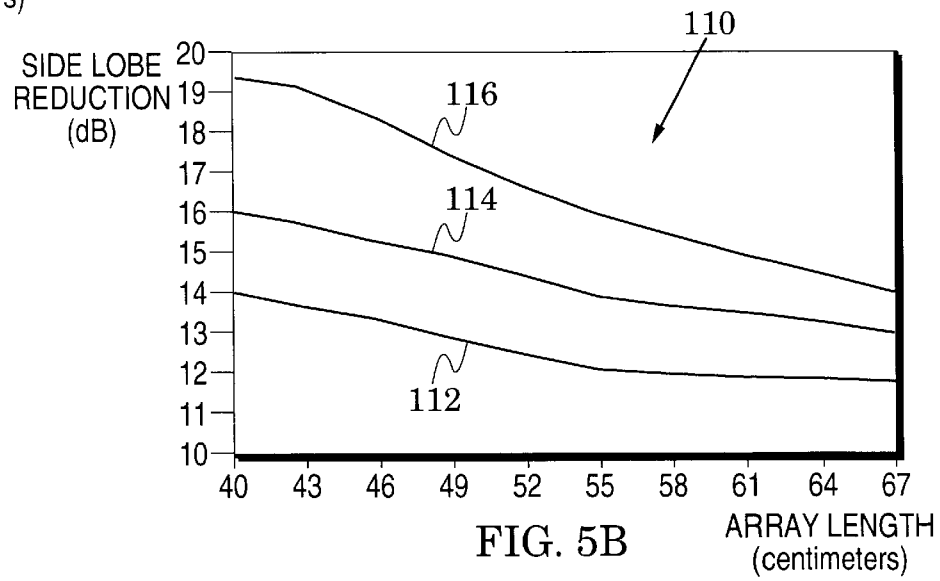
FIG. 5B is a graph of measured side-lobes in different prototypes of the end-fire array antenna of FIG. 1.

FIG. 2 illustrates the improvement in far-field antenna parameters that results when the divergent reflector 34 is incorporated into the end-fire array antenna 20 of FIG. 1. This measured improvement is shown in more detail in the graphs 100 and 110 of FIGS. 5A and 5B. These graphs document antenna performance which was measured on prototypes of the embodiment 40 of FIG. 2. The prototypes were designed to radiate and receive signals in S-band with a frequency of 2.5 GHz. Thus these prototypes had a design wavelength $\lambda_{dsgn}$ of ~12 centimeters.

Graph 100 plots antenna gain as a function of the length of the array 22 of FIG. 1. Plot 102 shows measured gain without the divergent reflector 34. First, second and third divergent reflectors were then coupled to the antenna and the gain remeasured for each antenna combination.

The first, second and third reflectors had aperture diameters (38 in FIG. 4) of approximately 1.38 $\lambda_{dsgn}$, 1.8 $\lambda_{dsgn}$ and 3.18 $\lambda_{dsgn}$ respectively. The diverging angle (84 in FIG. 4) decreased from 48 degrees for the first reflector to 24 degrees for the third reflector. The measured gains of the first, second and third reflectors are respectively shown as plots 104, 106 and 108. In these tests, the measured 3 dB bandwidth of the main lobe was typically in the region of 22–24 degrees.

Graph 110 plots side lobe reduction (relative to the main lobe) as a function of the array length. Plot 112 shows side lobe reduction with the divergent reflector 34 removed and plots 114 and 116 show side lobe reduction when the first and third reflectors were respectively coupled to the antenna.

In these prototypes, the diameter of the radiative members 24 and their axial spacing were both on the order of $0.25\lambda_{dsgn}$, the diameter of the radiator 44 was on the order of $0.5\lambda_{dsgn}$ and its spacing from the back wall (80 in FIG. 4) was less than $0.25\lambda_{dsgn}$. The probe 42 was moved outward on the radiator 44 until a predetermined probe impedance, e.g., 50 ohms, was obtained. The performance improvements of the prototype tests indicated that the diverging angle (38 in FIG. 4) is preferably in the range of 24–48 degrees.

Graphs 100 and 110 clearly show the improvement in antenna performance that is obtained with the divergent reflector 34. As expected, it was found that gain also improves with greater array length. Because larger diameter reflectors and longer arrays add size, weight and cost to the array antenna, measured performance such as that of graphs 100 and 110 is helpful in reaching a design compromise for each specific array antenna application.

The performance advantages of the divergent reflector can be designed into new end-fire array antennas. However, several industries (e.g., wireless cable television) have a great number (e.g., >1 million) of existing end-fire array antennas already in service. FIGS. 6, 7, 8A and 8B illustrate an antenna modification which enables the teachings of the invention to be incorporated into in-service antennas.

Figure 7:
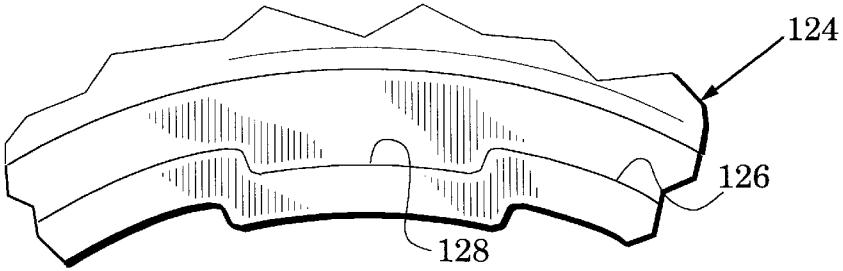
FIG. 7 is a view along the plane 7—7 of FIG. 6.
Figure 6:
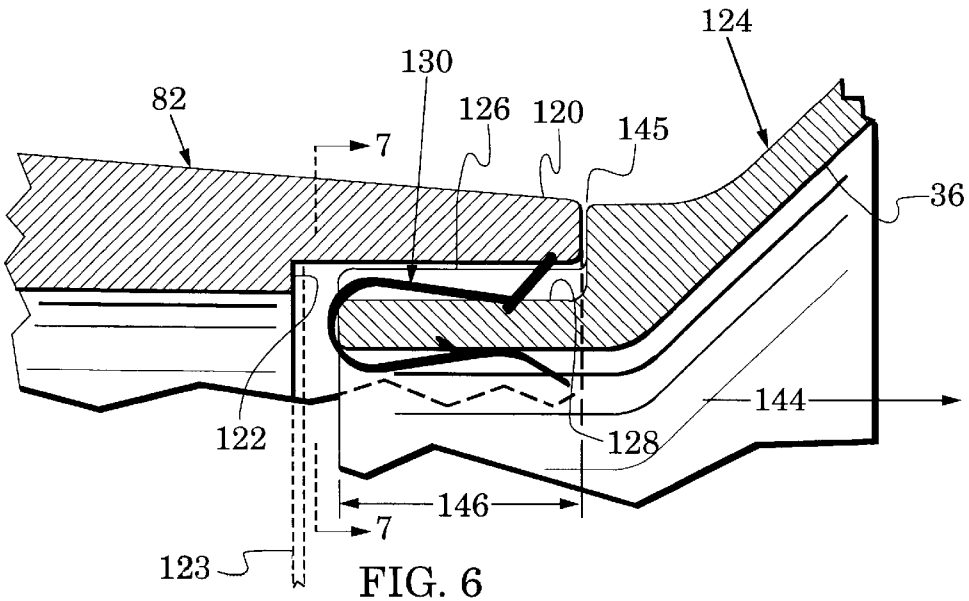
FIG. 6 is an enlarged view of the area within the curved line 6 of FIG. 4 which illustrates a combination of a field-retrofitted reflector and an existing cup-like reflector that realizes an electromagnetic equivalent of the reflector of FIG. 4.

In many in-service end-fire array antennas, the annular wall 82 of FIG. 4 terminates in an annular collar 120 as shown in FIG. 6. The collar 120 may also form a step 122 on its inner wall for receiving a protective dielectric weather radome 123. To adapt these antennas to the teachings of the invention, the divergent reflector 34 of FIG. 4 is modified to a divergent reflector 124 by terminating its diverging wall 36 in another annular collar 126 as shown in FIGS. 6 and 7. The collars 120 and 126 are dimensioned to mutually engage and the divergent reflector is held in position by one or more fasteners. The divergent reflector is now formed by radially separated inner and outer portions (the annular wall 82 and the diverging wall 36).

In a particular embodiment, several locations (e.g., three or four) along the perimeter of the collar 126 are radially indented to form the indented collar portion 128 of FIG. 7. The collar 126 is dimensioned to be received within the collar 120 and is maintained in that arrangement by a U-shaped, resilient clip 130.

Figure 8A:
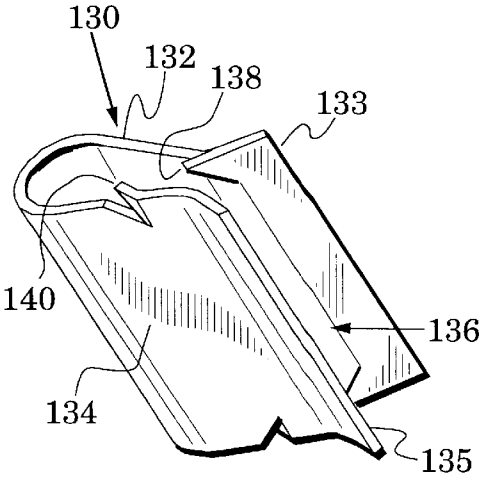
FIG. 8A is a perspective view of an installation clip in the reflector combination of FIG. 6.
Figure 8B:
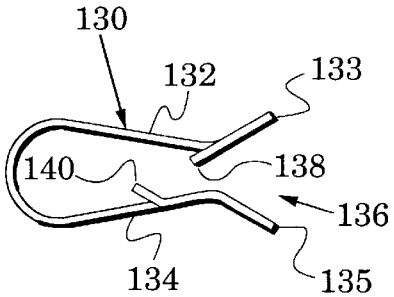
FIG. 8B is a side view of the installation clip of FIG. 8A.

An exemplary form of the clip 130 is shown in FIGS. 8A and 8B. The clip 130 has first and second legs 132 and 134 which respectively have ends 133 and 135 that flare away from each other to form an entrance 136. The first and second legs 132 and 134 respectively form teeth 138 and 140 which are directed opposite to the entrance 136. In addition, the first leg is dimensioned so that the transverse dimension between its end 133 and its teeth 138 exceeds the indentation of the collar portion 128 of FIG. 6. The clip 130 is preferably formed of a resilient material which will be resistant to weather corrosion, e.g., zinc-plated steel.

To modify an in-service end-fire array antenna, at least one of the resilient clips 130 is pressed over a collar portion 128 of a divergent reflector 124 as shown in FIG. 6. The entrance 136 of the clip receives the collar portion 128 and the clip's resilience urges the legs 132 and 134 to grip the portion 128 so that the clip is held in place.

The divergent reflector 124 is then positioned over the array (24 of FIG. 1) and urged so that its collar 126 is received into the collar 120 of the annular wall 82. Because the transverse dimension between the end 133 and the teeth 138 exceeds the indentation of the collar portion 128, the end 133 and the teeth 138 abut the collar 126 and the collar portion 128.

If external forces attempt to disengage the divergent reflector 124 (i.e., move it as indicated by the direction arrow 144), the leg end 133 is forced into the collar 120 and the teeth 138 and 140 are forced into the collar portion 128. The annular wall 82 is typically formed of a relatively soft, corrosion resistant material (e.g., aluminum or magnesium) and the divergent reflector 124 is preferably formed of a similar material. Accordingly, the end 133 and the teeth 138 and 140 are urged into this material and resist the disengagement force.

A passage 145 is formed between the collars 120 and 126. The collar 126 can be dimensioned so that radiation leakage through the passage 145 is minor. However, the leakage can be further reduced by designing the collar engagement distance (indicated by the distance arrow 146) to be $\sim 0.25\lambda_{dsgn}$. Thus, the open circuit at the outer end of the passage 145 is transformed to a short circuit at the passage's inner end so that the passage inner end appears to form a continuous wall with the metallic diverging wall 36 and the inner surface of the annular wall 82.

Figure 9:
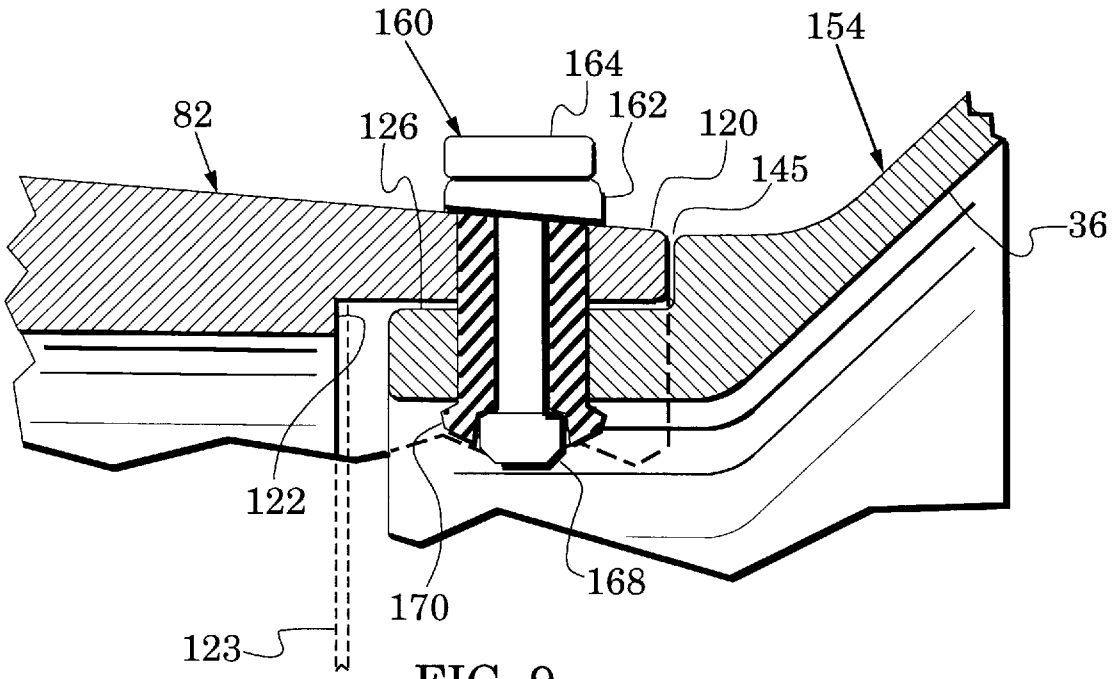
FIG. 9 is a view similar to FIG. 6 which illustrates another combination of a field-retrofitted reflector and an existing cup-like reflector.

Another divergent reflector modification which adapts an in-service end-fire array antenna to the teachings of the present invention is shown in FIG. 9. FIG. 9 is similar to FIG. 6 with like elements indicated by like reference numbers. A modified divergent reflector 154 is similar to the divergent reflector 124 of FIG. 6 but the indented collar portions (128 in FIG. 7) have been eliminated. In addition, the clip 130 is replaced by a two-part fastener 160 which has a collar portion 162 of a resilient material, e.g., plastic, and a pin portion 164 (for illustration clarity, most of the collar portion is shown in section).

As illustrated in FIG. 9, the collar portion 162 is inserted through holes in the collars 120 and 126. The pin portion 164 has an enlarged head 168. When the pin portion 164 is urged through the collar portion 162, the head 168 deforms an end 170 of the collar portion to retain the fastener 160 in place. Accordingly, the fastener 160 resists forces which tend to disengage the divergent reflector 154 and the annular wall 82.

End-fire array antenna embodiments have been described above and prototype realizations of these embodiments have been tested and demonstrated to have improved antenna performance. Functionally equivalent variations of these embodiments can be devised which also realize the teachings of the invention.

For example, the divergent reflector 34 of FIG. 1 has been shown to be cone-shaped, to have a conic frustum portion (the diverging wall 36 of FIG. 1) and a circular aperture (37 in FIG. 1). Other divergent radiative structures can be substituted. An exemplary one is a pyramid-shaped divergent reflector as indicated by the broken-line square aperture 177 in FIG. 1. This reflector would replace the conic frustum portion with a pyramidic frustum.

As a second example, the radiative members 24 of FIG. 1 have been shown to have a disc shape with a closed-curve (e.g., circular or elliptical) perimeter. Alternatively, other conventional radiative members can be substituted, e.g., the rectangular-shaped radiator 180 or the rod-shaped radiator 182 can be substituted as indicated by the substitution arrow 184 in FIG. 1. Because the radiative members 24 have a voltage minimum at their center, they can be supported by a rod (the rod 86 in FIGS. 1 and 4) that is formed of the same conductive material, e.g., aluminum. Alternatively, the radiative members can be metallic patches which are supported by a dielectric structure, e.g., microstrip patches.

As a third example, the annular wall 82 of FIG. 4 can be eliminated so that the conic frustum of the diverging wall 36 couples directly to the back wall 80 of the divergent reflector 34.

End-fire array antennas of the invention are useful for radiating and receiving electromagnetic signals of various polarizations, e.g., linear and circular. As is well known, antennas have the property of reciprocity, i.e., the characteristics of a given antenna are the same whether it is transmitting or receiving. The use of descriptive terms, e.g., radiative, in the description and claims are for convenience and clarity of illustration and are not intended to limit the teachings of the invention. An antenna which can generate and radiate microwave signals and signal patterns can inherently receive the same signals and patterns.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. An end-fire array antenna for radiation and reception of electromagnetic signals, comprising:

an array of radiative members which are arranged collinearly to define an antenna axis, said radiative members including a radiator and a plurality of directors;

a transverse wall arranged across said antenna axis and coupled to said directors with said radiator positioned between said transverse wall and said directors;

a probe connected to said radiator to facilitate passage of said electromagnetic signals; and a divergent reflector coupled to said transverse wall and having a reflector wall that diverges from said array to enhance radiation and reception of said electromagnetic signals.

2. The end-fire array antenna of claim 1, wherein said divergent reflector is cone-shaped.

3. The end-fire array antenna of claim 2, wherein said cone-shaped divergent reflector includes:

a cup coupled to said transverse wall and having an open end; and a conic frustum coupled to said open end.

4. The end-fire array antenna of claim 1, wherein said divergent reflector is pyramid-shaped.

5. The end-fire array antenna of claim 4, wherein said pyramid-shaped divergent reflector includes:

a cup coupled to said transverse wall and having an open end; and a pyramidic frustum coupled to said open end.

6. The end-fire array antenna of claim 1, wherein said reflector wall diverges from said array by an angle in the region of 24 to 48 degrees.

7. The end-fire array antenna of claim 1, wherein said electromagnetic signals have a wavelength in the region of an antenna design wavelength $\lambda_{dsgn}$ and said divergent reflector has an open end with a transverse width that exceeds 1.4 $\lambda_{dsgn}$.

8. The end-fire array antenna of claim 7, wherein said transverse width is between 1.4 $\lambda_{dsgn}$ and 3.2 $\lambda_{dsgn}$.

9. The end-fire array antenna of claim 1, wherein said radiative members are disc-shaped.

10. The end-fire array antenna of claim 1, wherein said radiative members have a rectangular shape.

11. The end-fire array antenna of claim 1, wherein said radiative members have a rod shape.

12. The end-fire array antenna of claim 1, wherein said divergent reflector is radially separated into inner and outer portions and further including at least one fastener configured to secure said inner and outer portions portions together.

13. The end-fire array antenna of claim 12, wherein said fastener includes:

a sleeve portion inserted through said inner and outer portions; and a rivet portion which is received into said sleeve portion.

14. The end-fire array antenna of claim 12, wherein said inner and outer portions each form a collar and one of said collars is received within the other of said collars.

15. The end-fire array antenna of claim 1, further including a rod which couples said directors to said transverse wall.

16. The end-fire array antenna of claim 1, further including a passage defined by and through said transverse wall and wherein said probe passes through said passage to connect to said radiator.

17. An end-fire array antenna for radiation and reception of electromagnetic signals, comprising:

a plurality of directors arranged collinearly to define an antenna axis;

a transverse wall arranged across said antenna axis and coupled to said directors;

a passage defined by and through said transverse wall;

a divergent reflector coupled to said transverse wall, said reflector diverging from said antenna axis and about said directors;

a radiator positioned between said transverse wall and said directors, said radiator and said directors forming an array of radiative members; and a probe that passes through said passage and is coupled to said radiator for coupling of said electromagnetic signals to and from said array;

said divergent reflector enhancing the radiation and reception of electromagnetic signals by said array.

18. The end-fire array antenna of claim 17, wherein said radiative members are disc-shaped.

19. The end-fire array antenna of claim 17, wherein said radiative members have a rectangular shape.

20. The end-fire array antenna of claim 17, wherein said radiative members have a rod shape.

21. The end-fire array antenna of claim 17, wherein said divergent reflector includes a reflector wall that diverges from said antenna axis by an angle in the region of 24 to 48 degrees.

22. An end-fire array antenna for radiation and reception of electromagnetic signals, comprising:

an array of disc-shaped radiative members which are arranged collinearly to define an antenna axis said radiative members including a radiator and a plurality of directors;

a transverse wall arranged across said antenna axis with said radiator positioned between said transverse wall and said directors;

a rod that carries said radiator and supports said directors from said transverse wall;

a passage defined by and through said transverse wall;

a probe that passes through said passage and connects to said radiator to couple said electromagnetic signals through said transverse wall; and a cone-shaped divergent reflector coupled to said transverse wall to enhance radiation and reception of said electromagnetic signals by said array, said reflector having a reflector wall that diverges from said array by an angle in the region of 24 to 48 degrees.

23. The end-fire array antenna of claim 22, wherein said divergent reflector is removably coupled to said transverse wall and further including at least one fastener positioned to prevent disengagement of said divergent reflector from said transverse wall.

24. The end-fire array antenna of claim 22, further including:

a first collar formed by said divergent reflector;

a second collar formed by said transverse wall; and at least one fastener;

wherein one of said collars is received within the other of said collars and said fastener is positioned to prevent disengagement of said collars.

25. The end-fire array antenna of claim 24, wherein said fastener includes a clip which is configured to engage said collars if said divergent reflector and said transverse wall move towards disengagement from each other.

26. The end-fire array antenna of claim 24, wherein said fastener includes:

a sleeve portion inserted through said collars; and a rivet portion which is received into said sleeve portion.

27. The end-fire array antenna of claim 24, wherein said electromagnetic signals have a wavelength in the region of an antenna design wavelength $\lambda_{dsgn}$ and said collars are mutually engaged for a distance of substantially 0.25 $\lambda_{dsgn}$.

28. An end-fire array antenna for radiation and reception of electromagnetic signals, comprising:

an array of radiative members which are arranged collinearly between an array first end and an array second end and which are spaced apart to facilitate radiation and reception of said electromagnetic signals in an antenna direction which extends collinearly from said array second end; and a divergent reflector arranged collinearly with said radiative members and spaced from said array first end to enhance radiation and reception of said electromagnetic signals in said antenna direction;

wherein said divergent reflector is radially separated into inner and outer portions and further including at least one fastener configured to secure said inner and outer portions together;

and wherein said fastener includes a resilient clip which is configured to engage said inner and outer portions if external forces urge said inner and outer portions to move towards disengagement from each other.

* * * * *